US006398132B1

(12) United States Patent
Junkel et al.

(10) Patent No.: US 6,398,132 B1
(45) Date of Patent: Jun. 4, 2002

(54) COOLING DEVICE USING FAN-DRIVEN MISTING WITH LARGE FILL AND DRINKING PORT

(75) Inventors: Eric F. Junkel, Des Plaines; Linda M. Usher, Chicago, both of IL (US)

(73) Assignee: Circulair, Inc., Chicago, IL (US)

( * ) Notice: Subject to any disclaimer, the term of this patent is extended or adjusted under 35 U.S.C. 154(b) by 0 days.

(21) Appl. No.: 09/290,056

(22) Filed: Apr. 12, 1999

(51) Int. Cl.[7] ..... B05B 15/00

(52) U.S. Cl. ..... 239/289; 239/333; 239/152; 222/383.1; 222/525; 222/175

(58) Field of Search ..... 239/71, 397.5, 239/128, 152, 289, 333; 222/383.1, 331, 525, 543, 175

(56) References Cited

U.S. PATENT DOCUMENTS

| | | | | | |
|---|---|---|---|---|---|
| 705,013 | A | * | 7/1902 | Baeuerle | |
| 3,997,115 | A | | 12/1976 | Licudine | |
| 4,700,892 | A | * | 10/1987 | Cunning | 239/289 |
| 4,705,191 | A | * | 11/1987 | Itzel et al. | 222/383 |
| 4,839,106 | A | | 6/1989 | Steiner | |
| 5,022,562 | A | * | 6/1991 | Lurkis et al. | 222/525 |
| 5,310,086 | A | * | 5/1994 | Julinot | 222/175 |
| D349,954 | S | | 8/1994 | Steiner et al. | |
| 5,338,495 | A | | 8/1994 | Steiner et al. | |
| 5,465,876 | A | * | 11/1995 | Crisci | 222/525 |
| 5,529,217 | A | * | 6/1996 | Siegel | 222/131 |
| 5,620,633 | A | | 4/1997 | Junkel et al. | |
| 5,667,731 | A | * | 9/1997 | Junkel et al. | 239/289 |
| 5,675,873 | A | * | 10/1997 | Groess | 24/284 |
| 5,697,153 | A | * | 12/1997 | Saaski et al. | 29/890 |
| 5,715,999 | A | * | 2/1998 | Hsu | 239/333 |
| 5,740,948 | A | * | 4/1998 | Chu et al. | 222/175 |
| 5,752,662 | A | * | 5/1998 | Hsu | 239/333 |
| 5,897,027 | A | * | 4/1999 | Steiner et al. | 222/383.1 |

* cited by examiner

*Primary Examiner*—Lesley D. Morris
*Assistant Examiner*—Christopher S Kim
(74) *Attorney, Agent, or Firm*—Gifford, Krass, Groh, Sprinkle, Anderson & Citkowski, P.C.

(57) ABSTRACT

A portable spray misting device including an internally hollowed body capable of holding a volume of fluid to be dispensed. The body includes a flattened base capable of supporting the body upon a flat surface and a contoured upper body terminating in an upwardly extending and interiorly open neck which defines a first port having a first diameter. A spray applicating head for issuing a mist spray of the fluid is secured to the open neck by an integrally formed collar. An interiorly open and annular rim extends from a specified location of the contoured upper body and defines a second port with a diameter greater than the first diameter of the first port. A cap is provided for securing in a fluid-tight manner over the annular rim of the second collar and so as to provide a device which permits a user to more quickly refill a fluid reservoir within the body interior and to facilitate reception of larger sized ice cubes and the like.

12 Claims, 16 Drawing Sheets

COOLING DEVICE USING FAN-DRIVEN MISTING WITH LARGE FILL AND DRINKING PORT

BACKGROUND OF THE INVENTION

1. Field of the Invention

The present invention relates generally to portable spray misting devices, both with and without fan assisting cooling and dispersion assemblies, and, more particularly, to a such a cooling device using fan-driven misting with a large fill and drinking port.

2. Description of the Prior Art

It is well known in the art that a fine mist or spray of a liquid can cool the surrounding air by evaporation and that this principle has been used in personal cooling devices. Cooling occurs when mist droplets impinge upon a target and are evaporated into the surrounding air. Additional cooling takes place if the liquid itself is very cold relative to the surrounding air and if an air stream blows on the user so as to accelerate the evaporation of water from the skin and clothing.

In practice, mists are generated inexpensively by actuation of a plastic trigger or by push button actuated piston pumps when the liquid contained within the dispensing body is at or near an atmospheric pressure and with aerosol valve/actuator sets when the liquid reservoir is above atmospheric pressure. Plastic piston pump misters are commonly and inexpensively available which employ a screw collar for attaching to the top of a conventional fluid-carrying bottle with a threaded neck.

However, the shortcoming of conventional bottle neck designs is that they are of standard dimension to accommodate the screw cap of the misting device and therefore do not easily permit the insertion into the container of ice cubes as one would want to do if the liquid in the reservoir needs to be cooled. It is also standard practice to have the spray mister removed from the fluid reservoir to permit repeated refilling. As a seal or gasket is often utilized between the annular collar of the mist sprayer attachment and the open neck of the receptacle, repeated loosening and tightening tends to result in early failure of the seal. Furthermore, if the user desires to repeatedly drink the water out of the reservoir or to empty it, the relatively small sized opening of the neck results in slow emptying and the user further cannot continue misting while refilling the reservoir.

SUMMARY OF THE PRESENT INVENTION

The present invention is a portable spray misting device which is an improvement over prior art spray misters. The device includes an internally hollowed body capable of holding a volume of a fluid to be dispensed. The body has a substantially flattened base, a contoured upper body, and terminates in an upwardly extending and interiorly open neck which defines a first port having a first diameter.

A spray applicating head is provided for issuing a mist spray of fluid and, according to one preferred embodiment, is secured atop the open neck of the body by a threaded collar. In additional preferred embodiments, the collar is permanently secured to the open neck by adhesives, heat staking, welding or securably fashioning a split collar around the open neck so as to sandwich therebetween a downwardly facing flange portion of the spray head.

An interiorly open and annular rim extends from a specified location of the contoured upper body and defines a second port having a second diameter greater than the first diameter of the first port. A cap is provided and is capable of being resecured over the annular rim so as to provide access to the reservoir defined within the body interior at a second location, the second port defined within being of sufficient diameter to permit the insertion of ice cubes and further operable to permit the user to quickly empty or refill the reservoir, to refill while utilizing the spray mister.

The cap preferably also includes a spout and valve assembly which is actuable between a first closed position and a second open position and permits the user access to the fluid interior through the second port and without the need to disengage the cap from the annular rim. Additionally, a portable fan unit including a plurality of rotatable blades is capable of being releasably secured atop the spray misting head and so as to direct the spray mist into a path of the rotating blades so as to further cool and distribute the spray.

The fan unit further includes an elongated pedestal support portion rotatably secured to the body of the fan unit and rotatable from a first hidden position to a second engaged position, upon detachment of the fan unit, in which the fan unit is capable of setting upon a table top surface. Additional features of the present device may include an insulating jacket applied around the internally hollowed body for maintaining the temperature of the fluid contents, a lanyard loop portion secured to the body, a belt clip extending from the body, and a decorative covering material applied over the body, such as a stuffed plush toy animal shape or the like. The covering material over the sprayer may also be provided as a molded vinyl piece.

BRIEF DESCRIPTION OF THE DRAWINGS

Reference will now be made to the attached drawings, when read in combination with the following specification, wherein like reference numerals refer to like parts throughout the several views, and in which.

DETAILED DESCRIPTION OF THE PREFERRED EMBODIMENTS

Figure 1:
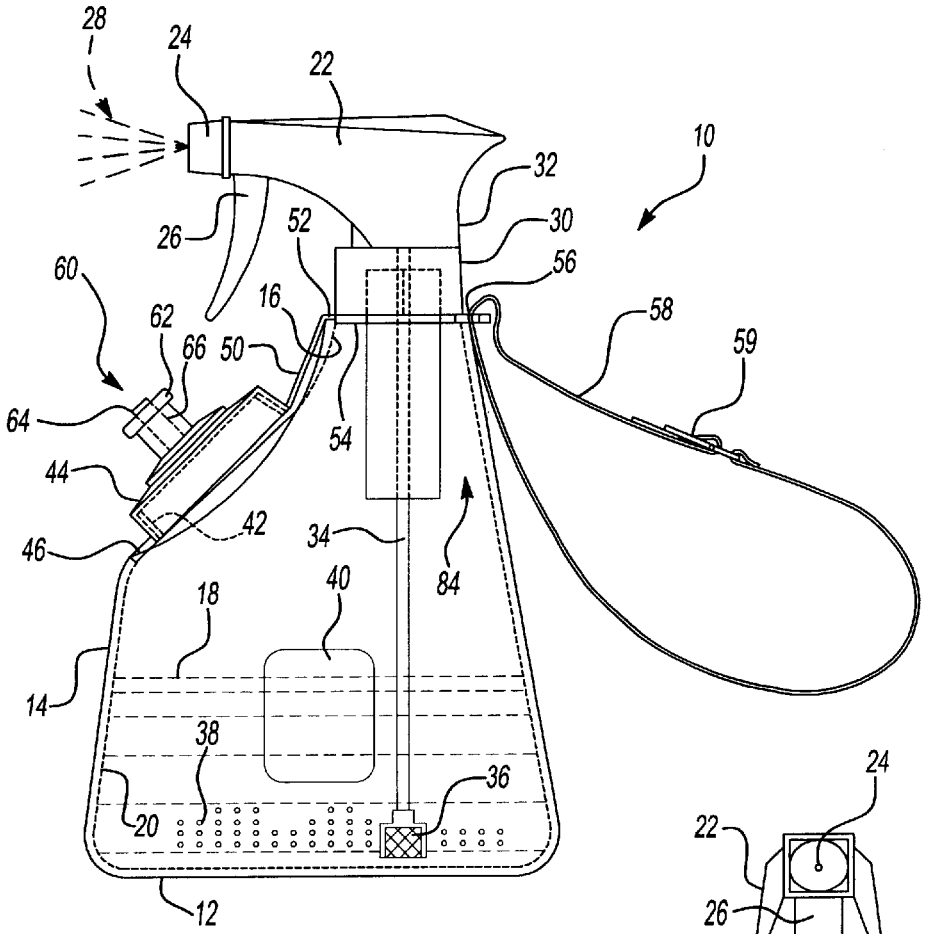
FIG. 1 is view of a portable spray misting device according to a first preferred embodiment of the present invention.
Figure 2:
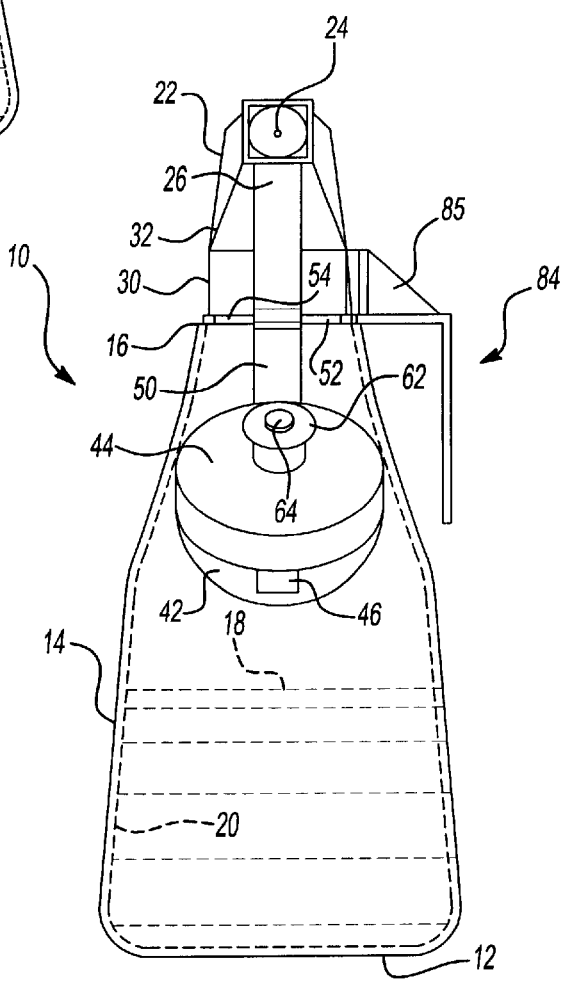
FIG. 2 is a front view of the portable spray misting device shown in FIG. 1 and further illustrating the second port with enclosure cap and spout and valve assembly for permitting access to the fluid receptacle according to the present invention.

Referring now to FIGS. 1 and 2, a portable spray misting device is illustrated at 10 according to a first preferred embodiment of the present invention. The spray misting device 10 includes an internally hollowed body which includes a substantially flattened base 12, a contoured upper body 14 and an upwardly extending and open neck 16 which defines a first port having a first established diameter. The misting device body is preferably constructed of a plasticized material, but may also be glass or any other suitable material.

The view of the internally hollowed body in FIG. 1 is partially cutaway an illustrates the internal fluid carrying reservoir formed within the body and which is defined by fluid level 18 and a surrounding wall thickness 20. A spray applicating head is shown at 22 and includes a nozzle 24 which is operable through a squeeze trigger 26 to issue a spray mist 28. An annular collar 30 is integrally formed with a base 32 of the spray head 22 and further includes an elongate and downwardly extending stem 34. The stem 34 terminates in an enlarged end containing a filtration portion 36, such portion being particularly suited for filtering out precipitated minerals (see within fluid level 18 at 38) resulting from melted ice cubes (at 40) which are capable of being deposited within the body interior as will be subsequently described.

Referring again to FIGS. 1 and 2, an annular rim 42 extends from a specified location of the contoured upper body 14 and defines a second port having a second diameter which is greater than the first diameter of the first port (or open neck 16). The annular rim 42 is preferably formed at an upper location relative to a top or side of the body and, in the present embodiment, is established in a generally upwardly and forwardly facing fashion relative to a front of the body as best shown in FIGS. 1 and 2.

A cap 44 is provided and which is capable of being resecurably attached over the annular rim 42 in secure and fluid sealing fashion. The cap 44 may include a tab 46 extending from a forward and lower edge thereof which is capable of being grasped to remove the cap 44 from the annular rim 42. The diameter of the second port defined by the annular rim 42 is again some value greater than the first port defined by the open neck of the bottle or internally hollowed body and is preferably at least 1.25 inches or greater in dimension for the purpose of easy emptying and refilling and to permit larger solid objects, such as ice cubes 40, to be inserted within the hollowed interior of the body.

Figure 3:
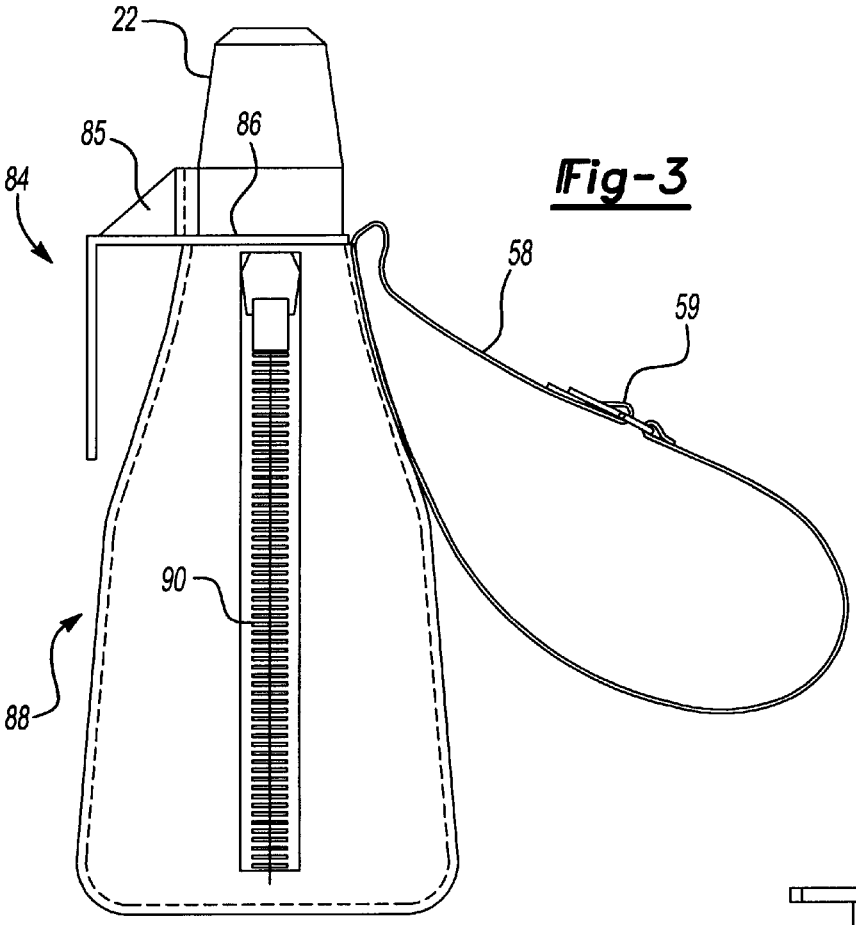
FIG. 3 is a rear view of a portable spray misting device and further showing an insulating jacket applied thereto as well as lanyard loop according to the present invention.
Figure 4A:
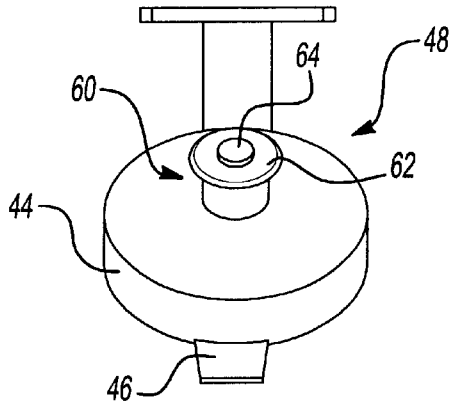
FIGS. 4*a*–4*c* are respective front, top and side views of an attachment ring according to a first preferred variant which extend from the covering cap of the second port and which securable at an opposite around the upwardly extending neck of the body.
Figure 4B:
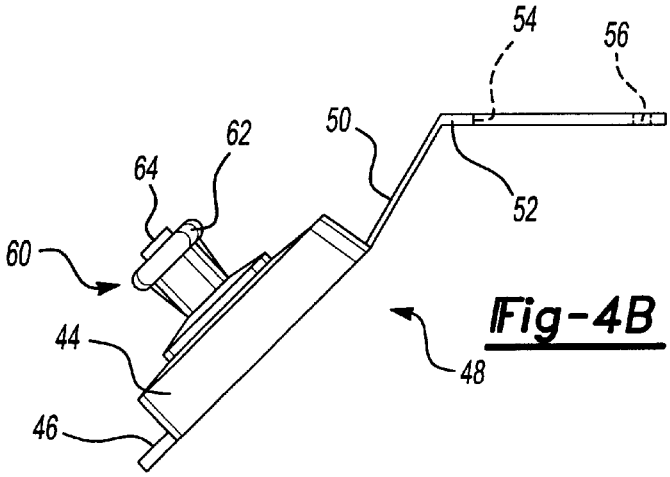
Figure 4C:
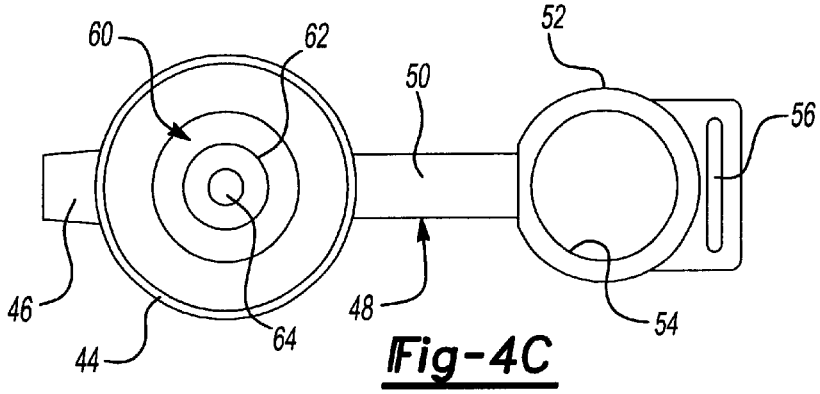

Referring again to FIGS. 1 and 2, and particularly further to FIGS. 4*a*–4*c*, an attachment ring assembly 48 is illustrated which includes the cap 44 and a connecting strap 50 extending therefrom which terminates in a further opposite ring 52 with a hollow center 54 for securing over the open neck 16 of the internally hollowed body. A slotted opening 56 is formed through a rear edge of the opposite ring 52 and accepts a lanyard loop 58 with adjustable strap portion 59 (see again FIGS. 1 and 3) for providing a convenient carrying strap arrangement to the present device. A spout and valve assembly 60 is also provided in the cap 44 covering the second port and includes an upwardly/downwardly and centrally hollowed actuable ring 62 which is configured so that, when pulled in the upward direction, reveals an open annular channel established with a central button 64 to permit fluid from the container to be emptied in a stream (see particularly the internal channel shown in phantom at 66 in FIG. 1 for providing fluid access).

Figure 5A:
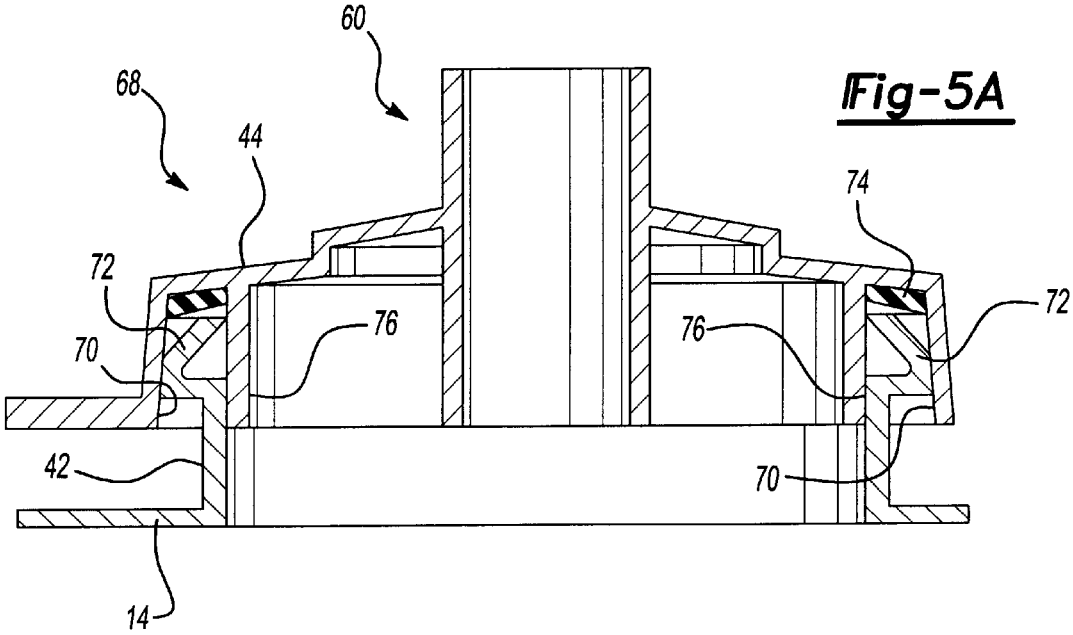
FIGS. 5*a* and 5*b* are respective friction fit and threaded engagement variations of the cap with the annular rim of the second port according to the present invention.

Referring to FIG. 5*a*, a sectional side view is illustrated at 68 in cutaway of the engagement between the annular rim 42 of the second port and the releasably affixable cap 44 according to a primary preferred embodiment. The cap 44 includes an inwardly facing surface annular surface 70 which defines an interference or friction fit with a contoured and outwardly facing surface 72 of the annular rim 42. A circular gasket 74 is also arrayed between the annular surfaces 70 and 72 and the cap 44 may further include a coaxially spaced inner annular wall 76 for pinching the contoured surface 72 of the rim 42 therebetween.

Figure 5B:
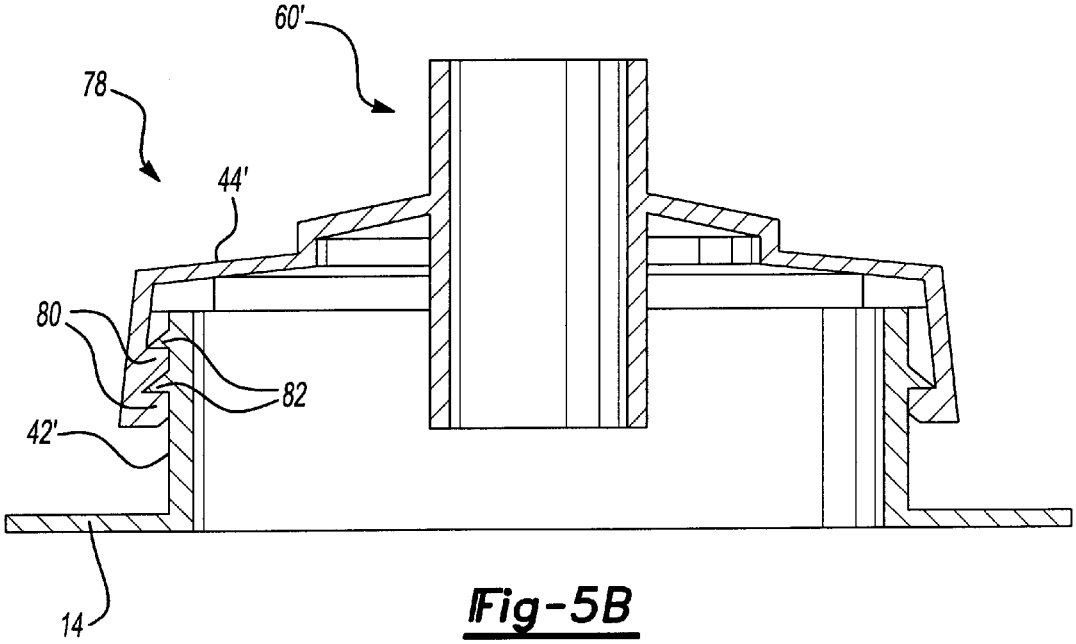

Referring to FIG. 5*b*, a further variant 78 of the engagement between an annular rim 42' and a releasably affixable cap 44' is illustrated and includes a plurality of inwardly facing screw threads 80 which extend from the annular cap 44' and which rotatably interengage with exterior threads 82 extending from the annular rim 42'. A central through aperture for a spout and valve assembly 60' is likewise illustrated.

Figure 6A:
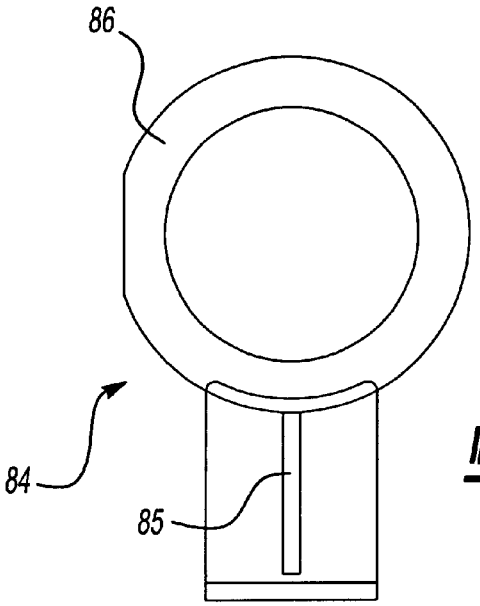
FIGS. 6*a*–6*c* are respective top, side and front views of a belt clip which extends from the internally hollowed body according to the present invention.
Figure 6B:
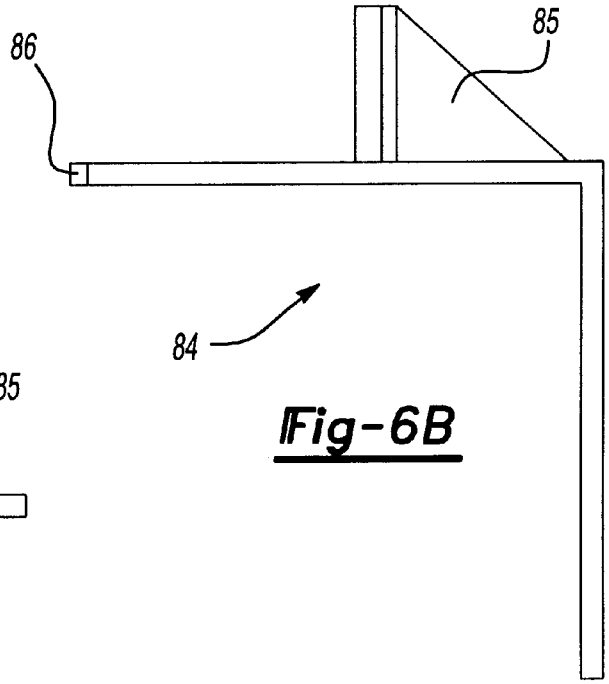
Figure 6C:
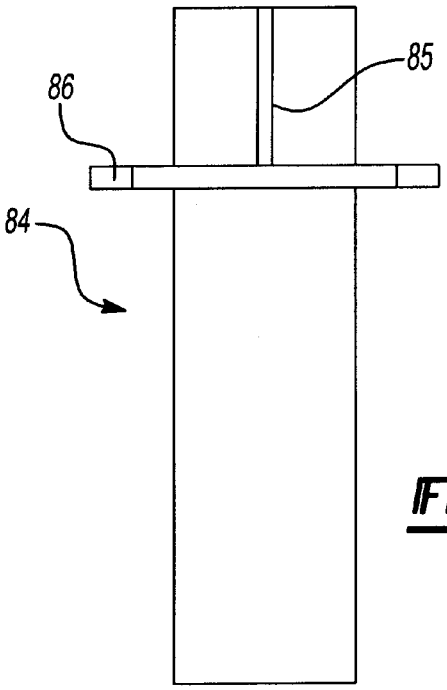

Referring again to FIGS. 1–3 and also to FIGS. 6*a*–6*c*, a belt clip 84 is illustrated which includes a substantially "L" shaped and angular body with a reinforcing bracket portion 85 and a circular mounting portion 86 capable of being secured to the open neck 16 bottle. Referring to FIG. 3, an insulating jacket 88 is provided which is constructed of an appropriate insulating material which is also flexible to a degree and which is configured for insertingly receiving the body of the spray misting device 10. A zipper 90 is provided running substantially vertically along a rear side of the device 10 and for resealably closing the insulating jacket 88 around the device body, however it is understood that other alternative sealing means may also be employed such as Velcro™ attachments, loop fasteners and the like.

As is again shown in FIG. 1, the configuration of the second port is such that ice cubes 40 may be inserted within the internally hollowed body. This is of particular advantage since the diameter of the first port (or open neck 16) is typically such as to prevent passage of normal sized ice cubes and further since that repeated opening and closing of the annular collar 80 will over time cause damage to or failure of the gasket or seal (again at 74 in FIGS. 5*a* and 5*b*).

Figure 7:
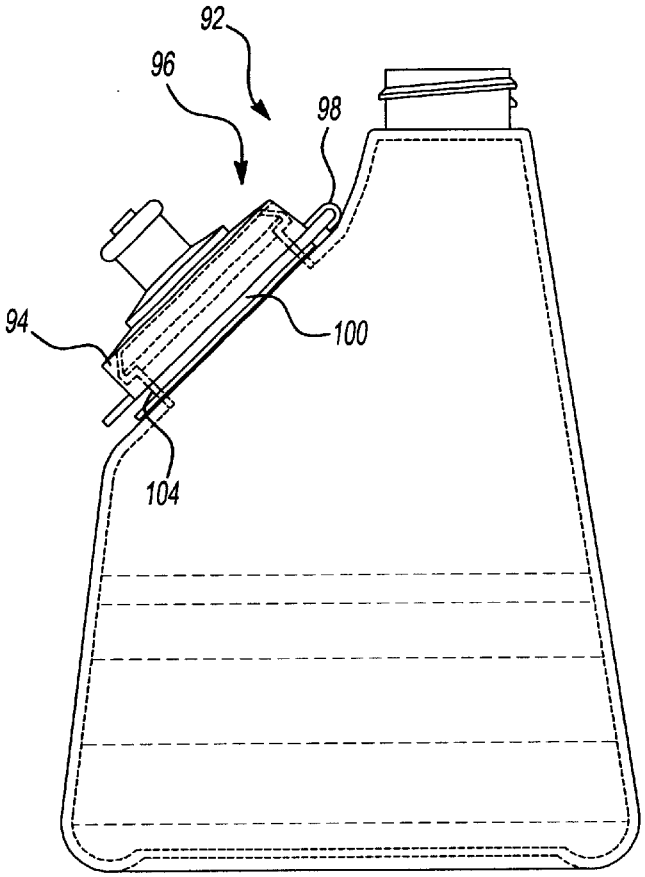
FIG. 7 is a view of an internally hollowed body of a spray misting device according to a further preferred embodiment and including a further variation of an attachment ring which is securable at an opposite end about the annular rim.
Figure 8A:
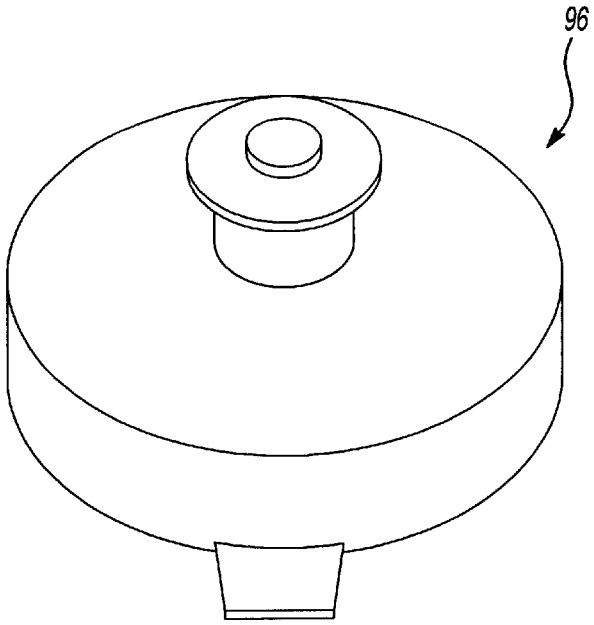
FIGS. 8*a*–8*c* are respective front, side and top views of the attachment ring shown in FIG. 7 according to the present invention.
Figure 8B:
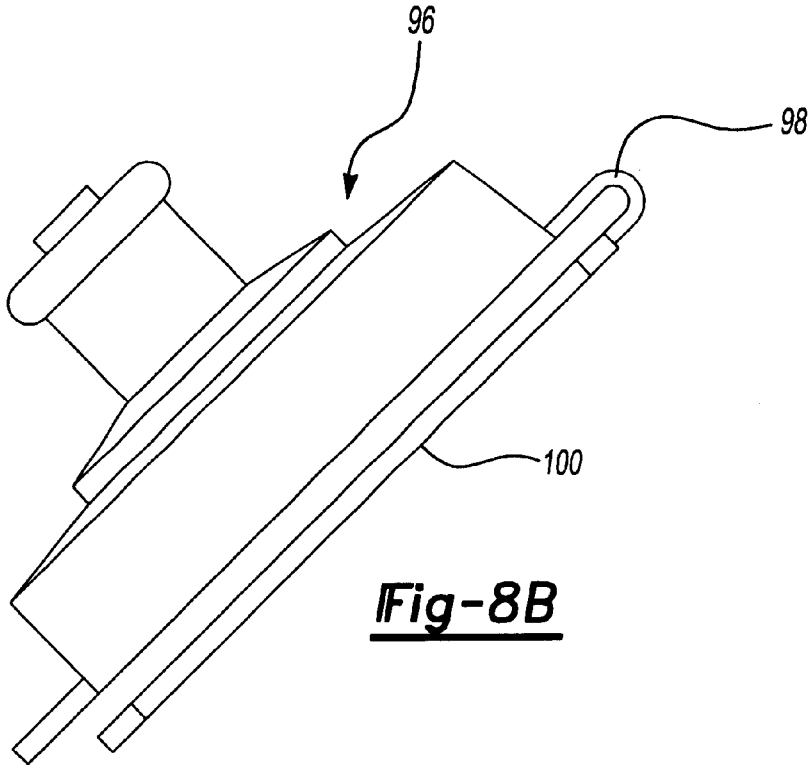
Figure 8C:
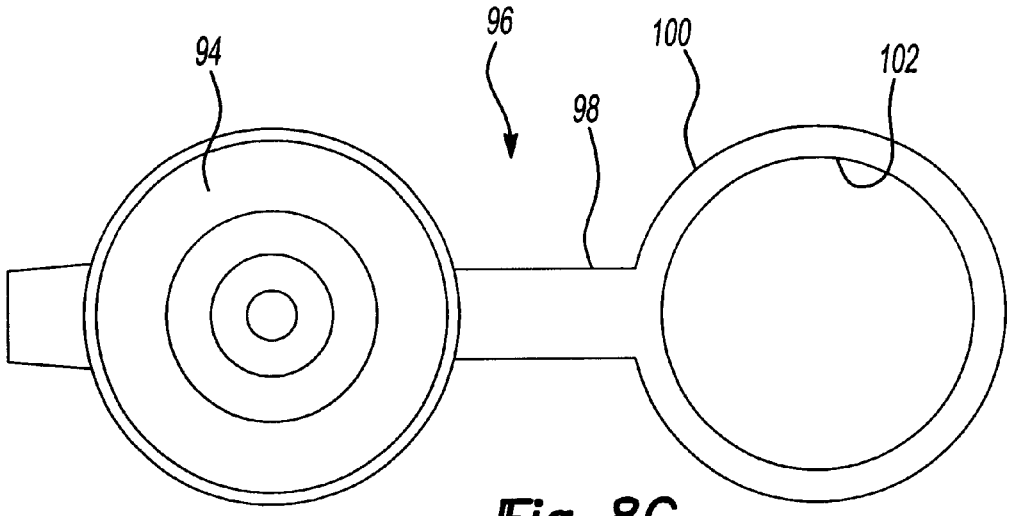

Referring to FIG. 7, a further variation 92 of a internally hollowed base for receiving a spray applicating head is illustrated and differs substantially only in the manner in which a cap 94 and attachment ring assembly 96 is secured to the body and second port. Specifically, and also viewing FIGS. 8*a*–8*c*, the attachment ring assembly includes a connecting strap 98 which secures at one end to the cap 94 and also to an opposite ring 100. The connecting strap 98 is much smaller in length than its counterpart at 50 in the embodiment of FIGS. 4*a*–4*c* and the corresponding opposite ring 100 with hollow center 102 is larger in diameter than its counterpart 52 at 54. The purpose of the opposite ring 100 of the attachment ring assembly 96 is to secure around annular rim 104 (again FIG. 7) and to provide a retaining means for the cap 94 when it is disengaged from the annular rim 104 in a fashion such as has been previously described with reference to FIGS. 5*a* or 5*b*. This is alternative once again to the embodiment of FIGS. 1–6 in which the opposite ring 52 secures about the open neck 16 of the internally hollowed body. The embodiment of FIG. 7 is otherwise substantially identical to that previously described and such that additional explanation is unnecessary.

Figure 9A:
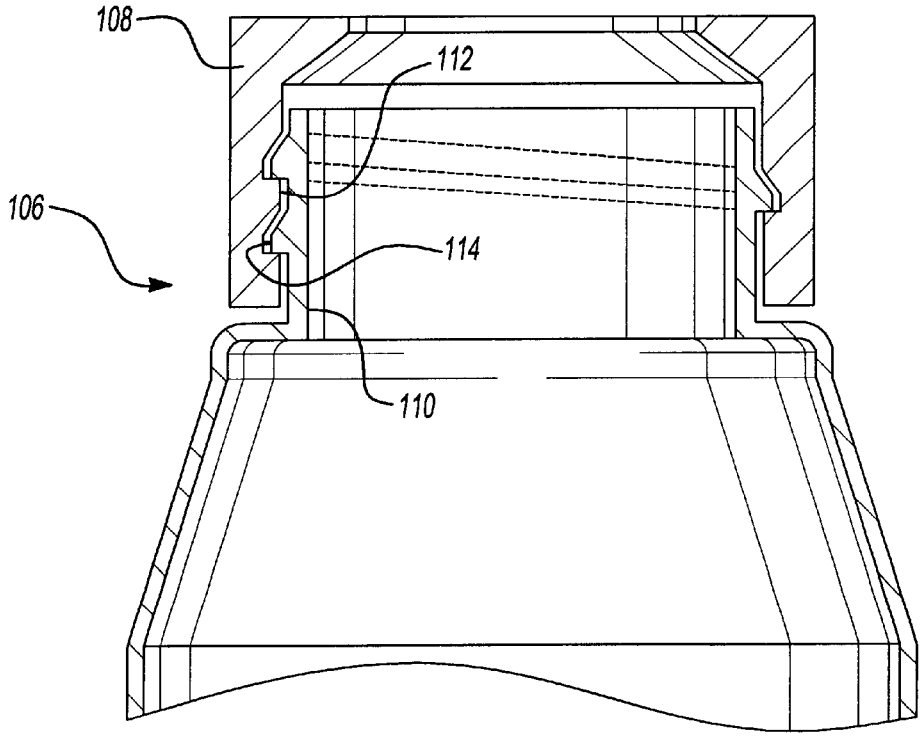
FIGS. 9*a* and 9*b* are respective side cutaway sectional views of open threaded necks of the internally hollowed body and illustrate both screw mating of an annular collar integrally formed with the spray misting head and permanent adhesive securing of the collar to the open neck according to the present invention.

Referring now to FIG. 9*a*, a side view in cutaway is illustrated of a first further preferred variant 106 for securing an annular collar 108 to an open neck 110 of a spray misting bottle. Specifically, FIG. 9*a* illustrates a conventional screw thread arrangement for securing the collar 108 and which includes internal threads 112 formed within the annular collar 108 which rotatably interengage with corresponding external threads 114 formed in the open neck.

Figure 9B:
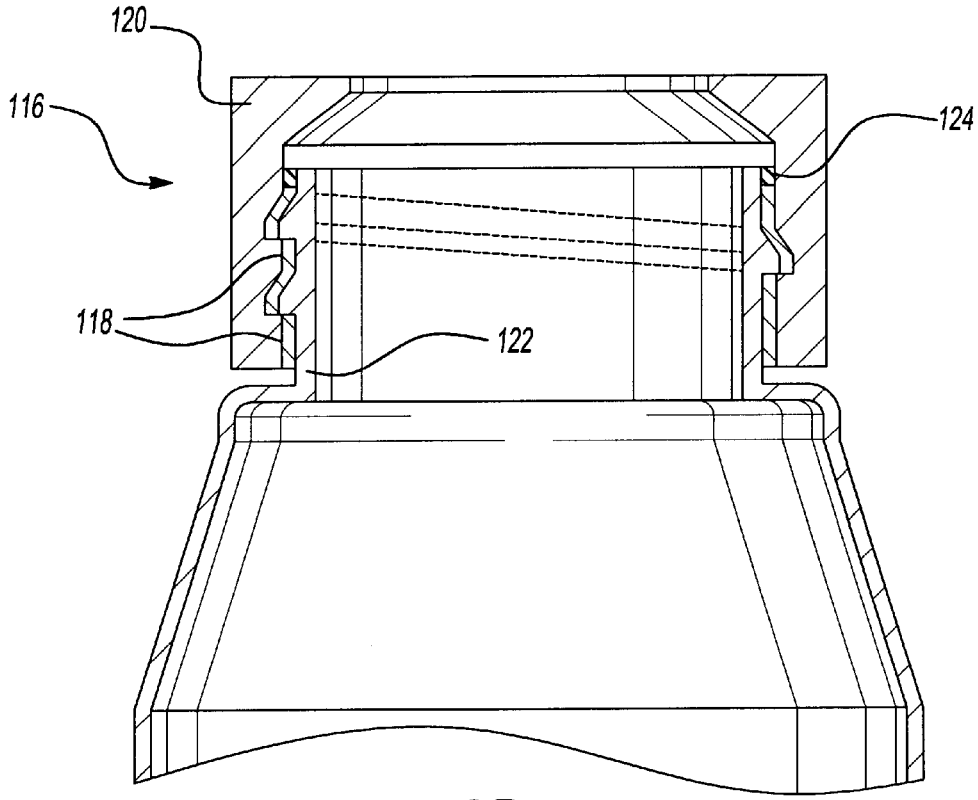

Referring now to FIG. 9*b*, an alternate variation is further illustrated at 116 and includes an adhesive 118 applied to mating surfaces of an annular collar 120 and open neck 122 for the purpose of securably and permanently fixing the annular collar 120 atop the spray misting bottle. As was previously stated, a purpose for permanently affixing the collar and spray applicating head atop the misting bottle is to provide the ability to continuously utilize the misting feature and also to protect against wear and tear of a seal or gasket 124 existing between the annular collar 120 and open neck 122.

Figure 10A:
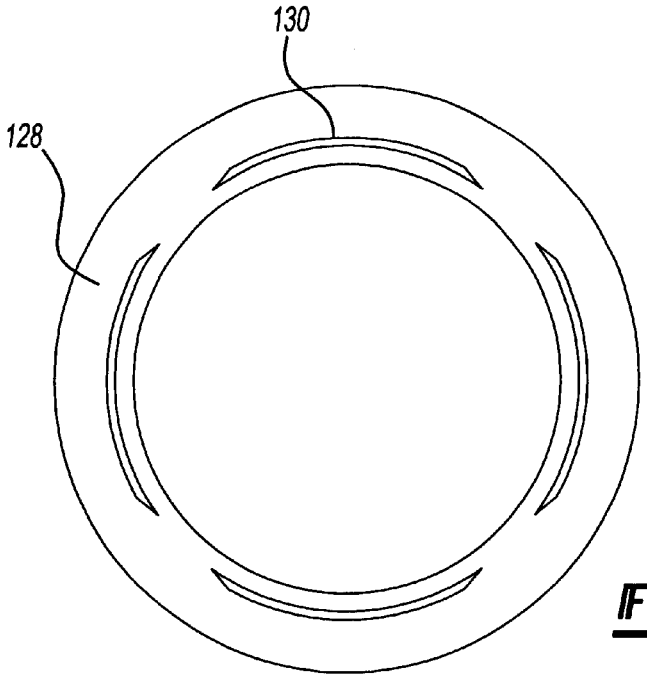
FIGS. 10*a* and 10*b* are respective top and side cutaway views of a collar of a spray misting head permanently secured to an open neck by ultrasonic welding.
Figure 10B:
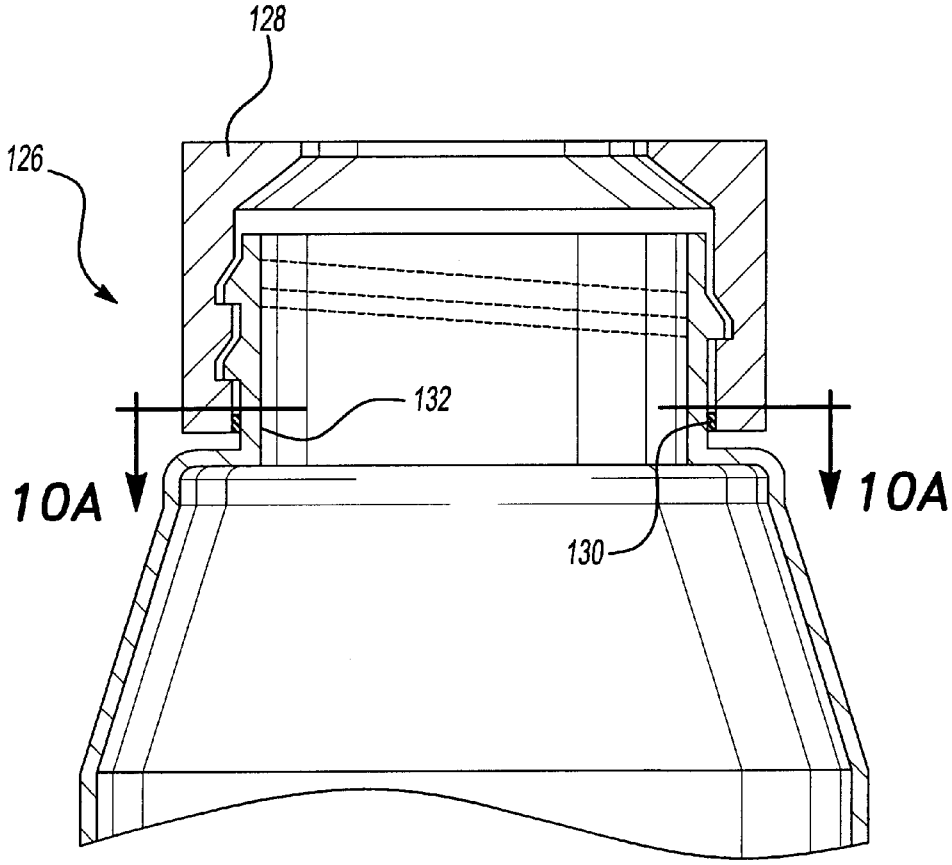
Figure 11A:
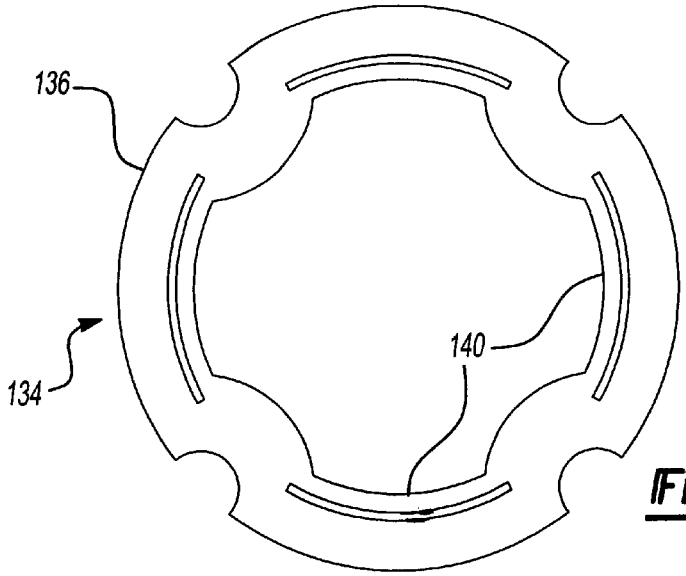
FIGS. 11*a* and 11*b* are respective top and side cutaway views of a collar of a spray misting head permanently secured to an open neck by heat staking the collar to the neck.
Figure 11B:
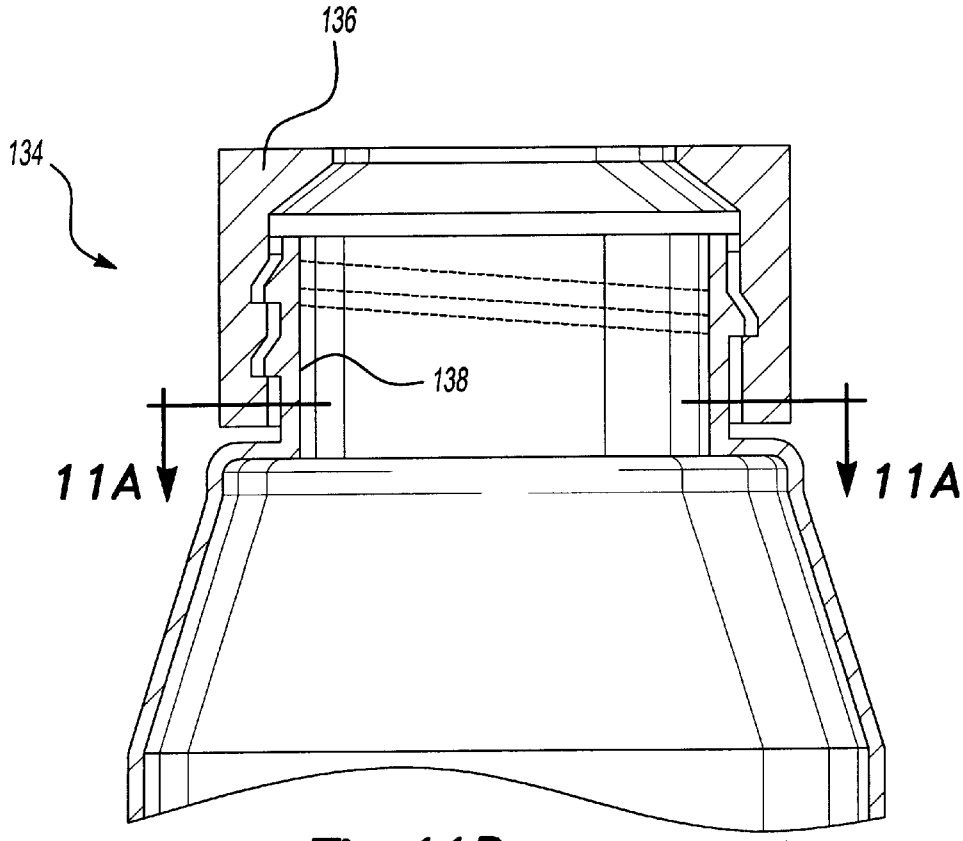

Referring now to FIGS. 10*a* and 10*b*, a further variation 126 of attaching an annular collar 128 is illustrated and includes annular arrayed and ultrasonic welds 130 applied between the collar 128 and open neck 132 for the purpose of permanently affixing the collar 128 to the misting bottle. The ultrasonic welds function to cause friction between two pieces of plastic rubbing together to generate heat, melting one or both of the opposing surfaces. The melted plastic bonds the two parts when the melted interface cools. The welds 130 may be applied in any conventional fashion by tools known in the art and are preferably drawn from a heated and viscous polymer material which will bond integrally with the preferable polymer construction of the annular collar 128. Referring to FIGS. 11*a* and 11*b*, a yet further variation 134 for securing an annular collar 136 atop an open neck 138 of a spray bottle in secure and permanent fashion is provided by a heat staking process which involves applying heat to annular inner surfaces 140 of the annular collar 136 which in turn cause the collar to bond intimately with the corresponding outwardly facing annular surfaces of the open neck 138 in a process somewhat similar to the application of an external welding material such as in FIGS. 10*a* and 10*b*.

Figure 12A:
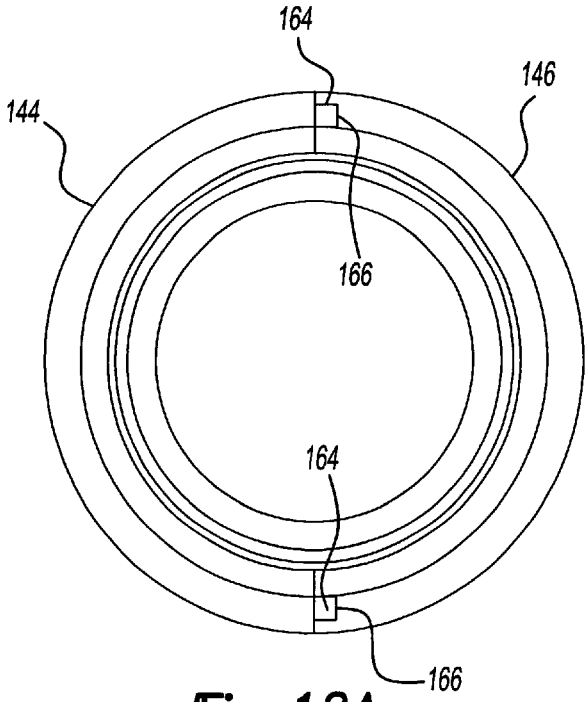
FIGS. 12*a*–12*c* are respective top, first side and second side views of a split collar arrangement assembleable around the open neck and sandwiching therebetween a downwardly facing flange portion of the spray misting head according to the present invention.
Figure 12B:
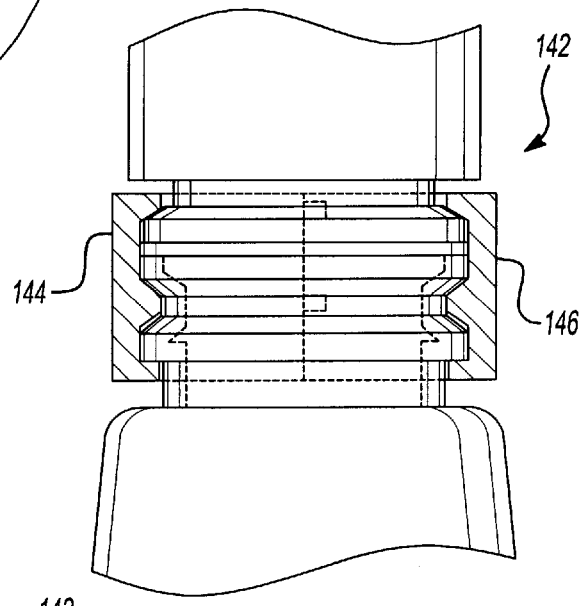
Figure 12C:
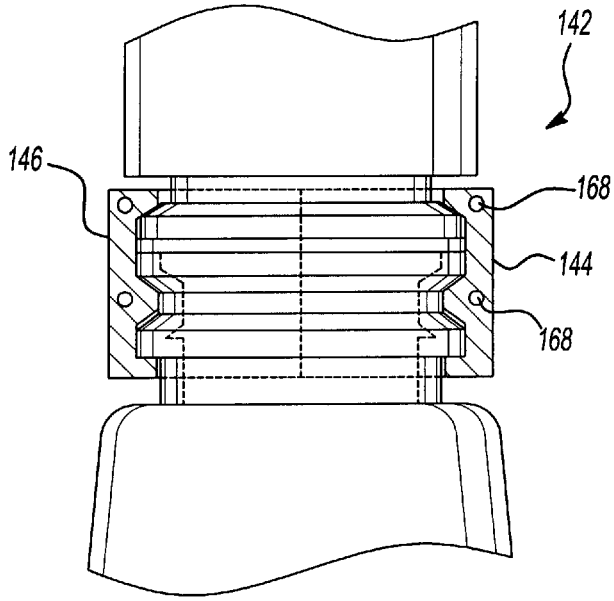
Figure 13:
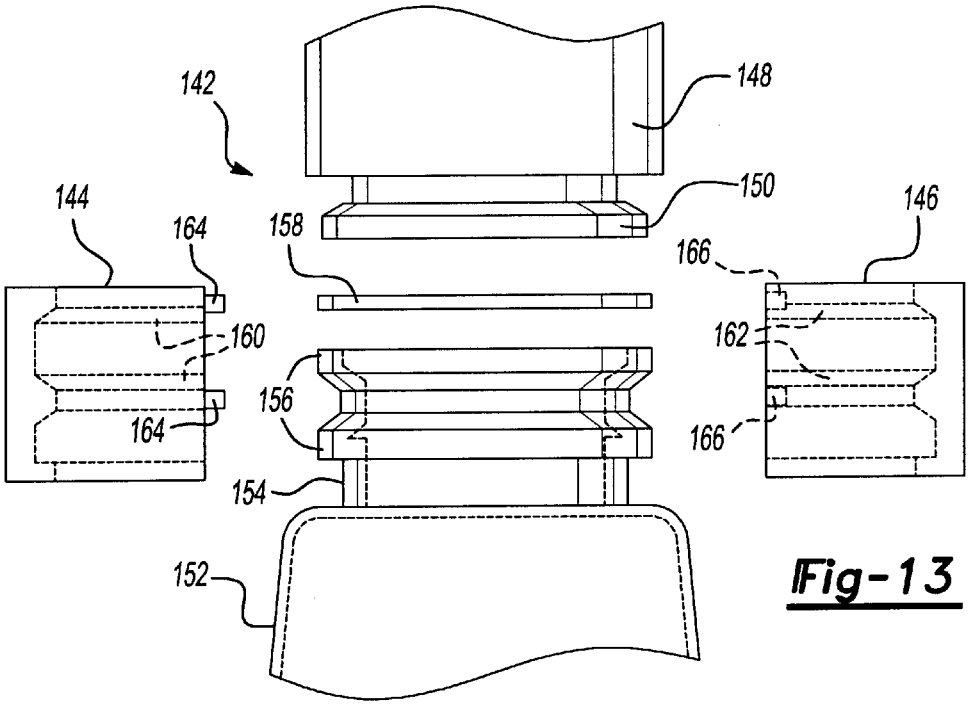
FIG. 13 is an exploded view of the split collar illustrated in FIGS. 12*a*–12*c* and the manner of securing to the open neck to sandwich the spray misting head flange therebetween.

Referring further to FIGS. 12*a*–12*c* and also to FIG. 13, a still further variation 142 is illustrated of an annular collar attachment means for permanently securing a spray applicating head atop a misting bottle. Specifically, the annular collar is provided in an assembleable and clamping arrangement and includes a first half 144 and a second half 146. The halves 144 and 146 are to be secured together by applied adhesives or ultrasonic welding as previously described. As is also shown in FIG. 13, a spray applicating head includes a lower body 148 and terminates in a downwardly facing flange portion 150. An internally hollowed body 152 includes an open neck 154 upon which are configured outwardly flared portions 156. A gasket or seal 158 is also illustrated in the exploded view of FIG. 13 and is sandwiched between the downwardly facing flange portion 150 of the spray applicating head 148 and the upwardly facing surface of the open neck 154 upon application of the first and second halves 144 and 146 annular collar.

The first half 144 includes an inner annular contour, as illustrated by phantom lines 160, and which are matched by corresponding phantom lines 162 for providing a like inner annular contour in the second half 146 as best shown in FIG. 13. Alignment pins 164 extending from the first half 144 engage within corresponding recesses 166 in the second half 146 to secure the collar in mating fashion about the open neck 154 and sandwiching the downwardly facing flange 150. Referring once again to FIG. 12*c*, the first and second halves may also be assembled together through the use of pins 168 which recess within like configured apertures in the collar halves.

Figure 14:
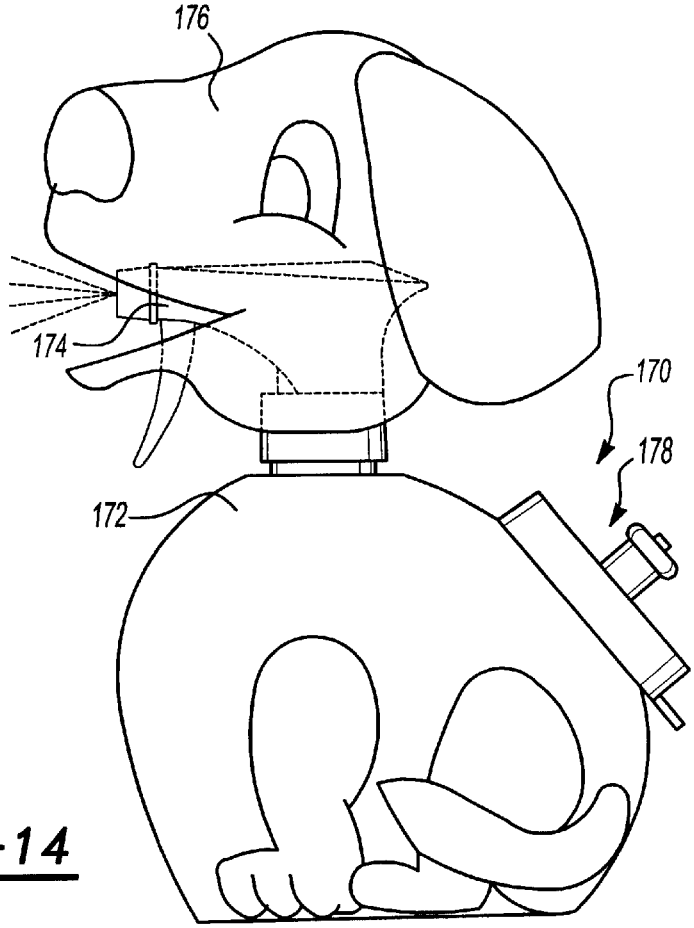
FIG. 14 is a view of a decorative covering material capable of being applied over the spray misting device according to a further preferred embodiment of the present invention.

Referring now to FIG. 14, a further embodiment 170 is disclosed of a spray misting device of the present invention and includes a decorative covering material 172 applied over the spray misting device. The device includes in one preferred variant an internally hollowed body (substantially hidden from view), a spray applicating head 174 camouflaged within a decorative head 176 of similar material to that of the covering material 172 and affixed over the spray applicating head 174, and a second port assembly 178 which is identical in construction to that previously described. The decorative covering material may consist of any animal design or the like and is intended to be an attractive addition to the portable spray misting device of the invention. Alternatively, the bottle itself may be constructed as the decorative design without departing from the scope of the invention.

Figure 15:
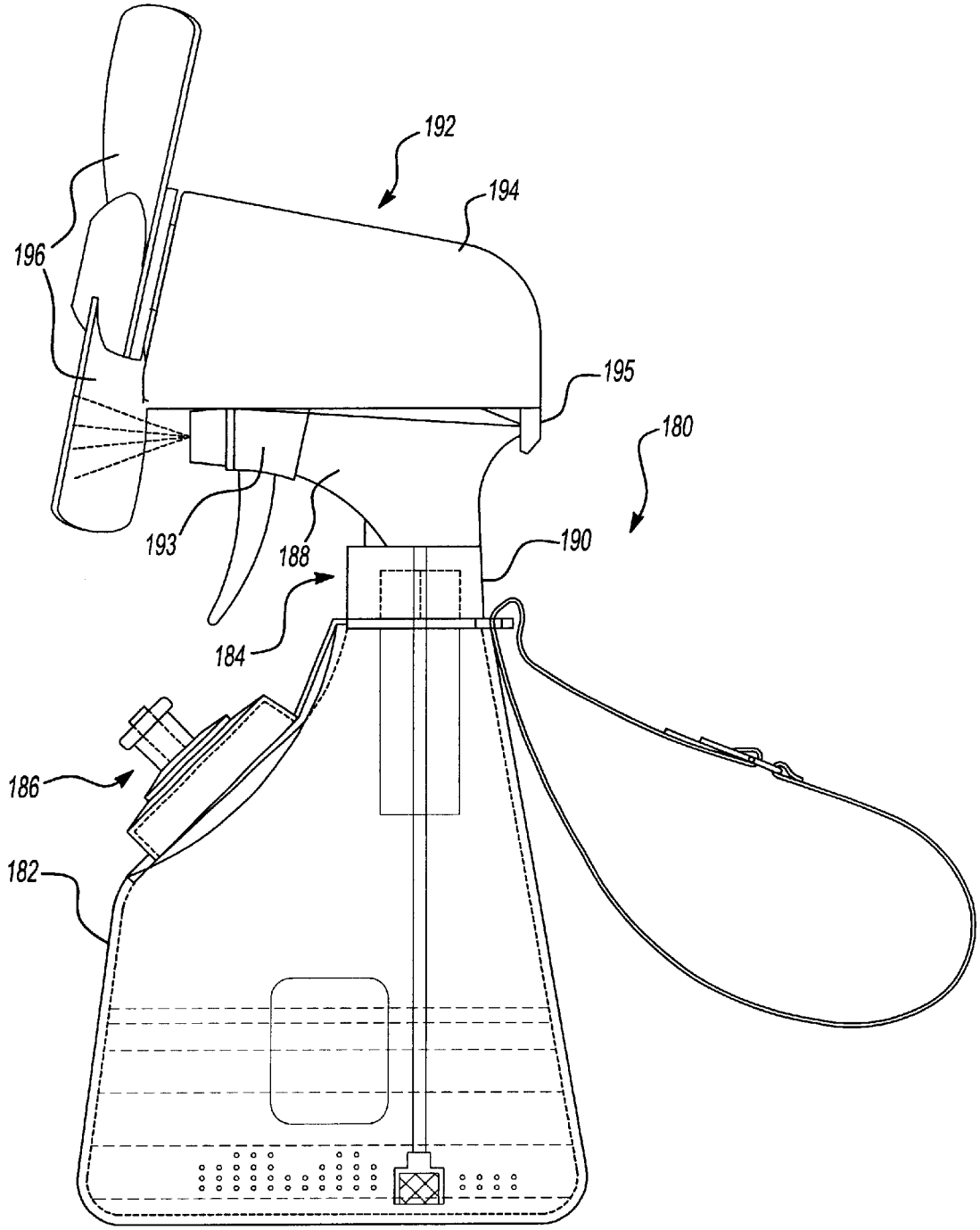
FIG. 15 is a view of the portable spray misting device according to a further preferred embodiment and including a portable fan unit resecurably attachable atop the spray misting head according to the present invention.

Referring now to FIG. 15, a portable spray misting device is illustrated at 180 according to a yet further preferred embodiment of the present invention. The device 180 again includes an internally hollowed misting bottle 182 with first port 184 and second larger fill port 186 and also with a spray applicating head 188 which is secured by an annular collar 190 to the first port 184. The device 180 differs in that it also discloses a portable fan unit 192 having a body 194 and a plurality of blades 196 which are rotatably connected to the body 194 of the unit. The fan unit 192 is releasably secured atop the spray applicating head 193 such as through the use of downwardly extending engaging tabs (forward at 193 and rearward at 195) which are contoured for gripping corresponding locations of the spray applicating head. Upon issuance of a mist spray directed into a path of the rotating fan blades 196, the mist contacts the blades and is cooled and distributed further, such as through evaporation into the surrounding air. The construction and operation of the spray misting device 180 is further substantially identical to that disclosed in the earlier preferred embodiments, particularly FIGS. 1–6, such that a repetitive explanation is unnecessary.

Figure 16:
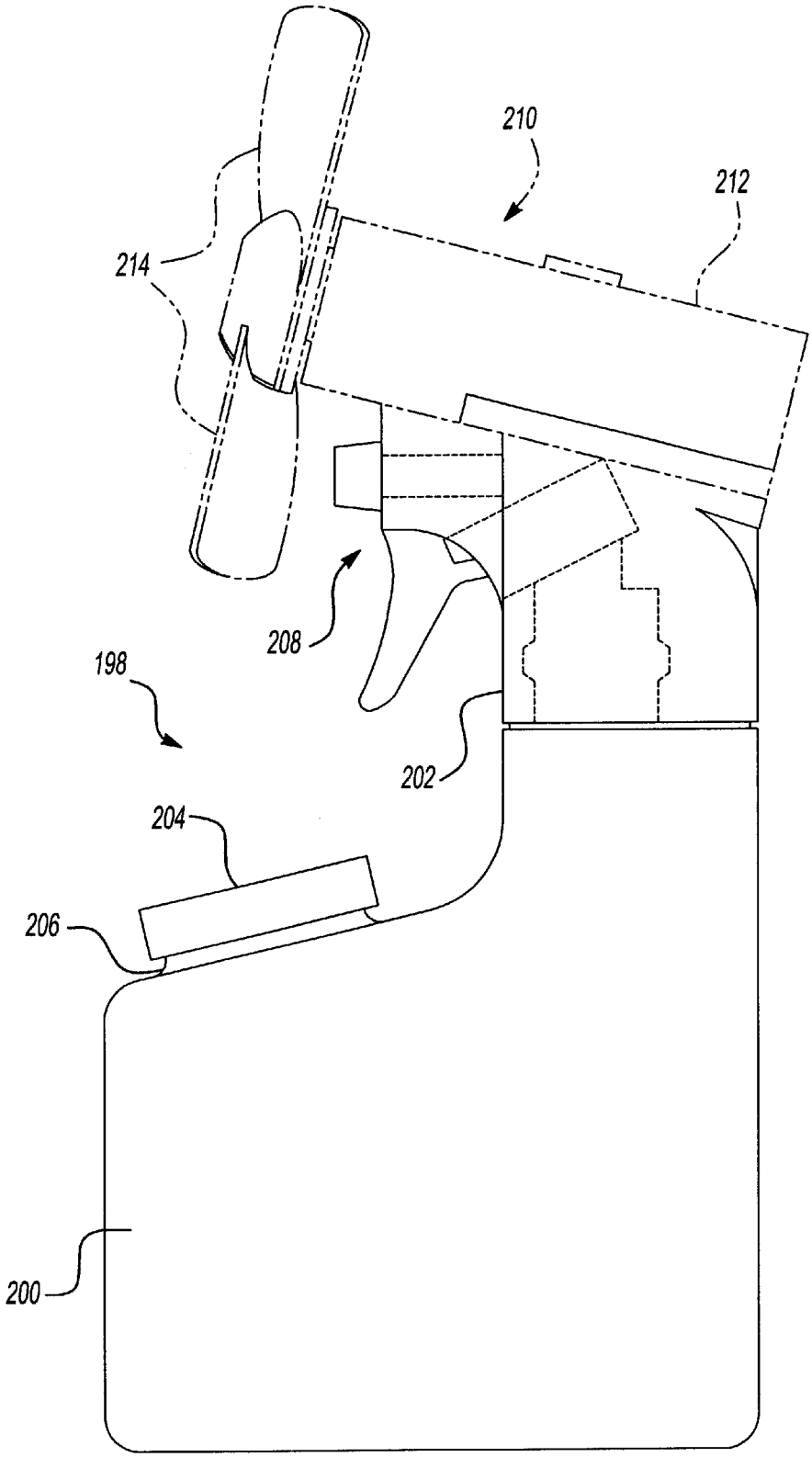
FIG. 16 is a view of the portable spray misting device, similar in respects to that shown in FIG. 15, and according to a still further preferred embodiment of the present invention.
Figure 17:
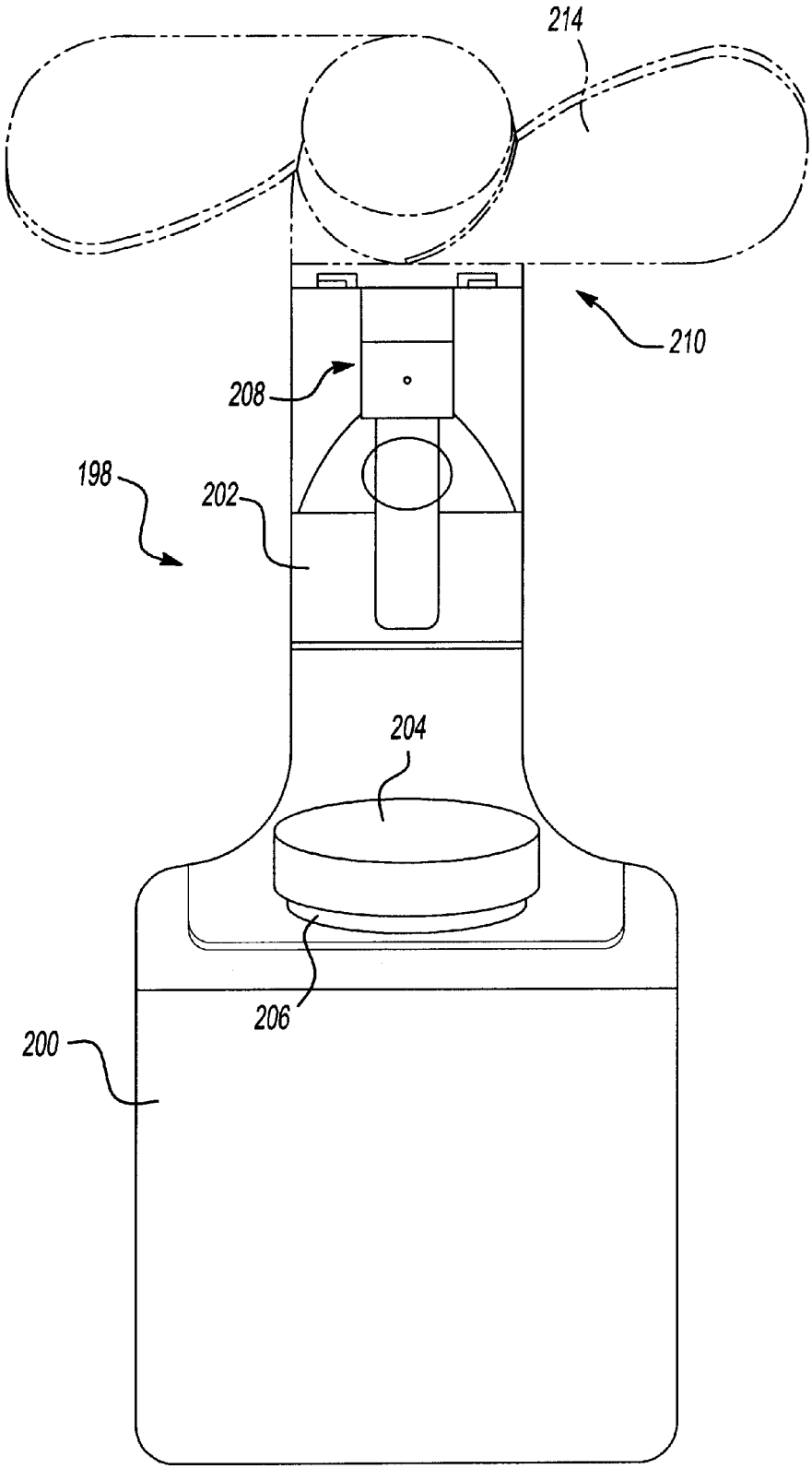
FIG. 17 is a front view of the portable spray misting device as shown in FIG. 16.

Referring now to FIGS. 16 and 17, side and front views are shown respectively of a portable spray misting device 198 according to a further preferred variant. The misting device 198 is similar in most regards to that illustrated at 180 in FIG. 15 in that it includes an internally hollowed body 200 with an upper neck 202 defining a first port and a cap 204 affixable in a fashion previously described over a configured annular rim 206 to define a second port. The embodiment of FIGS. 15 and 16 include a spray applicating head assembly 208 which is substantially integrally formed with the upwardly extending upper neck 202.

A portable fan unit 210 having a body 212 and rotatable blades 214 secured to the body 212 is illustrated secured atop the spray applicating head assembly 208. The fan unit 210 is capable of being secured by gripping tabs such as was previously described with reference to the embodiment of FIG. 15 or may be secured by other means such a sliding track arrangement existing between an underside of the fan unit body and the corresponding mounting surface extending from the top of the spray applicating head. As is best illustrated with reference to FIGS. 18–21 in succession, the fan unit 210 is dismountable from atop the spray applicating head and is capable of being separately utilized.

Figure 18:
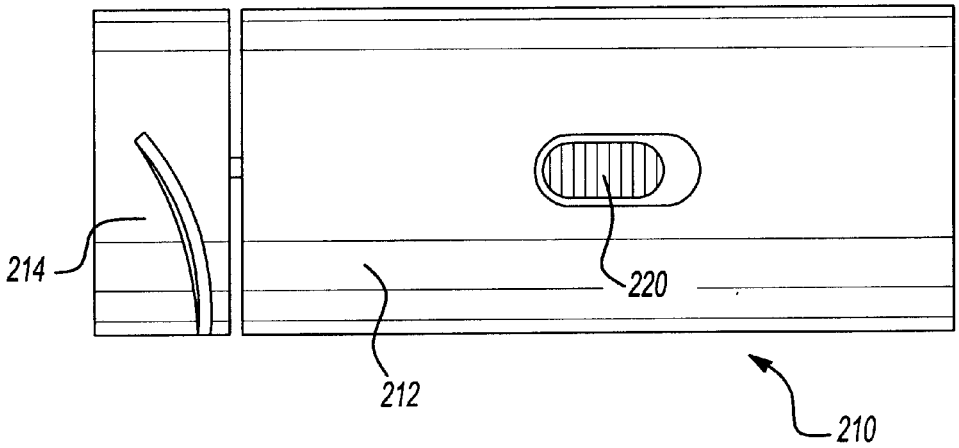
FIG. 18 is a top view of the portable fan unit as shown in FIGS. 15 and 17 and capable of being disengaged from the spray misting unit.
Figure 19:
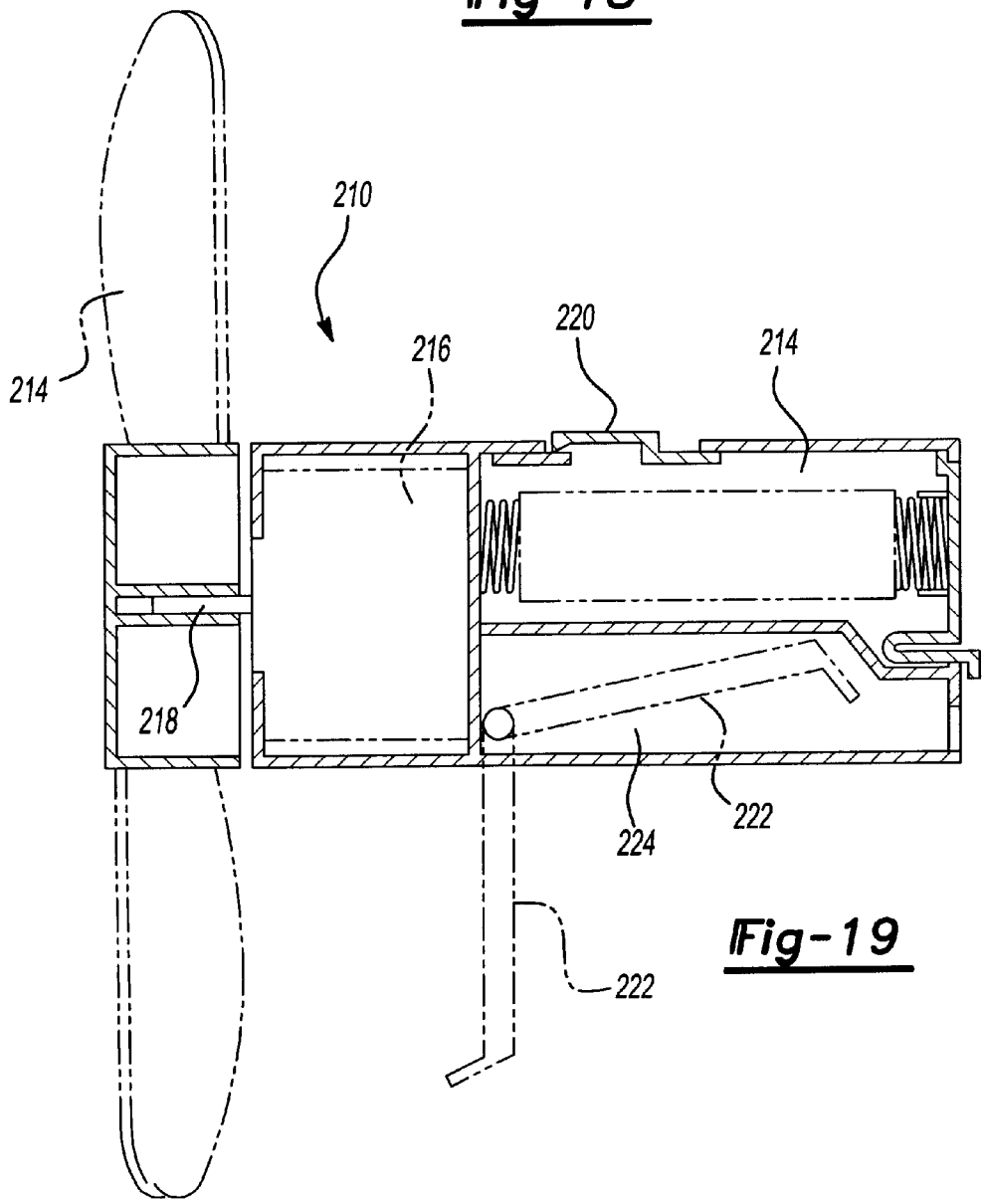
FIG. 19 is a side cutaway view of the portable fan unit as shown in FIG. 18 and illustrating in phantom the elongate pedestal support portion.

Specifically, referring to FIG. 19, a cutaway view is shown of the fan unit 210 which includes one or more batteries 214 contained within the unit body 212 and a small electric motor 216 which is operatively powered by the battery to drive the fan blades 214 via a drive shaft 218. Referring also to FIG. 18, an on/off switch 220 is provided for selectively activating and deactivating the fan unit 210.

Figure 20:
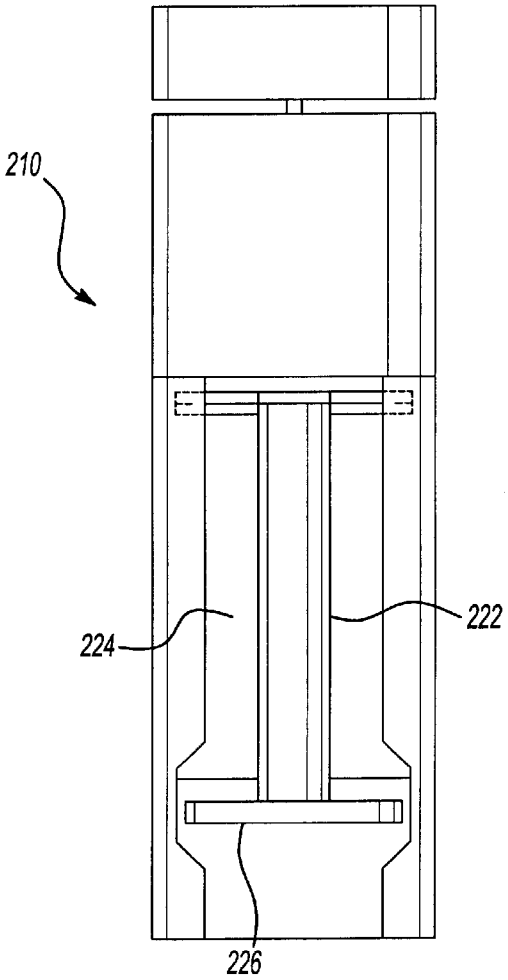
FIG. 20 is a bottom view of the fan unit shown in FIGS. 18 and 19 and further illustrating in extra detail the elongate pedestal support portion.
Figure 21:
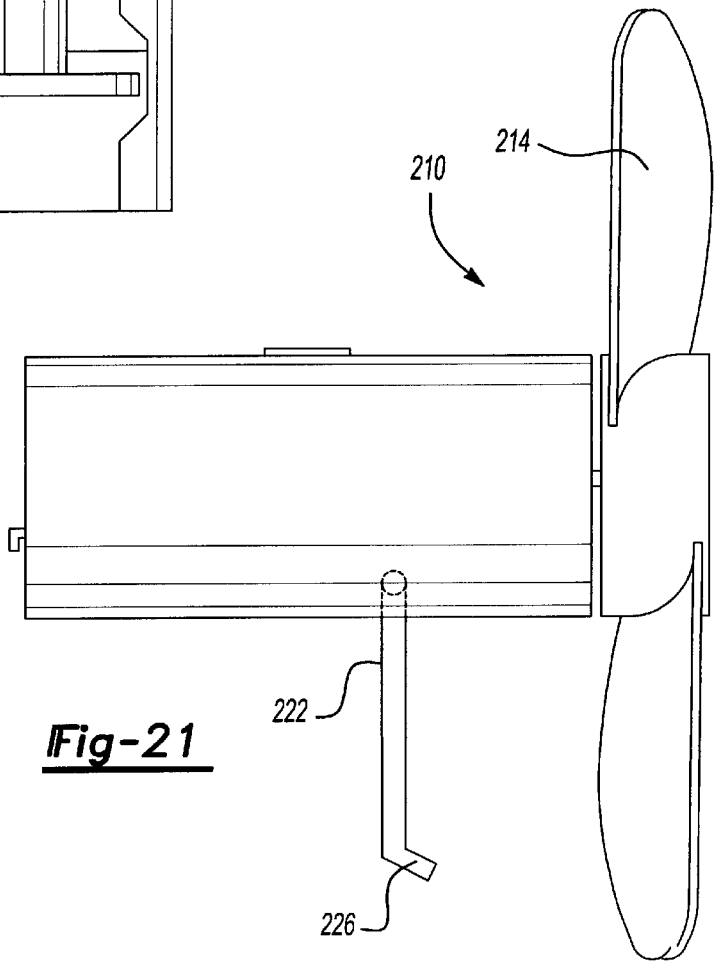
FIG. 21 is a side view in solid which is largely identical to that shown in FIG. 19 and illustrating the pedestal support portion of the fan unit in a downwardly rotated and engaged position.

Referring again to FIG. 19, and also to FIGS. 20 and 21, an elongate pedestal support portion 222 is provided which is recessed in a first folded position (see phantom lines in FIG. 19) within a compartment 224 of the fan unit body. The pedestal support portion 222 includes (as best illustrated from the detached and underside view of FIG. 20) a laterally extending foot portion 226 which permits the pedestal support portion 222, upon it being rotated from the first hidden position to a second engaged position as also shown again in FIGS. 19 and 21, to engage a table top surface (not shown) and to support the fan unit in an upwardly angled and operative condition apart from its use with the spray misting device.

Having described my invention, it will become apparent that it discloses a novel and useful cooling device using fan-driven misting with a large fill or drinking port which is a non-obvious improvement over prior art devices. Having described my invention, additional preferred embodiments will become apparent to those skilled in the art to which it pertains without deviating from the scope of the appended claims.

We claim:

1. A portable spray misting device comprising:

an internally hollowed body capable of holding a volume of a fluid to be dispensed, said body having a substantially flattened base and a contoured upper body, said body terminating in an upwardly extending and interiorly open neck which defines a first port having a first diameter;

a spray applicating head for issuing a mist spray of said fluid and securing means for attaching said applicating head to said open neck, said securing means further comprising an annular collar defining a first half and a second half, said halves being assembled around said open neck so as to sandwich an annular and downwardly facing flange portion of said spray head;

an interiorly open and annular rim extending from a specified location of said contoured upper body and defining a second port, said second port having a second diameter which is greater than said first diameter;

a cap and resecuring means for securing said cap in a fluid-tight manner over said second port; and a portable fan unit including a plurality of blades rotatably connected to said unit, said fan unit being releasably secured atop said spray applicating head so that said mist spray is directed into a path of said rotating blades and, upon contact with said blades, is cooled and distributed.

2. The portable spray misting device as described in claim 1, said cap further comprising a spout and valve assembly actuable between a first closed position and a second open position.

3. The portable spray misting device as described in claim 2, further comprising a retaining strap extending between said cap and said body.

4. The portable spray misting device as described in claim 3, said retaining strap further comprising an attachment ring capable of being secured about said body.

5. The portable spray misting device as described in claim 4, further comprising said attachment ring securing about said upwardly extending neck.

6. The portable spray misting device as described in claim 4, further comprising said attachment ring securing about said annular rim.

7. The portable spray misting device as described in claim 1, said resecuring means further comprising an inwardly facing surface of said cap defining an interference fit with a corresponding outwardly facing surface of said annular rim of said second port.

8. The portable spray misting device as described in claim 1, said fan unit further comprising an elongate pedestal support portion rotatably secured to a body of said fan unit, said support portion being rotated from a first hidden position to a second engaged position upon releasably securing said fan unit from spray applicating head and for supporting said fan unit upon a table top surface.

9. The portable spray misting device as described in claim 1, further comprising an insulating jacket and means for applying said jacked around said internally hollowed body.

10. The portable spray misting device as described in claim 1, further comprising a lanyard loop portion secured to said body.

11. The portable spray misting device as described in claim 1, further comprising a belt clip extending from said body.

12. The portable spray misting device as described in claim 1, further comprising a decorative covering material applied over said body.

* * * * *